US006593842B2

(12) United States Patent
Haynam et al.

(10) Patent No.: US 6,593,842 B2
(45) Date of Patent: Jul. 15, 2003

(54) POLYMERIC CUTOUT ASSEMBLY

(75) Inventors: Jason R. Haynam, Columbia, MO (US); John A. Roche, Columbia, MO (US); John A. Krause, Medina, OH (US); Mike J. O'Laughlin, Columbia, MO (US); Hester Mae McEuen, Centralia, MO (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/939,797

(22) Filed: Aug. 28, 2001

(65) Prior Publication Data

US 2002/0158745 A1 Oct. 31, 2002

Related U.S. Application Data

(60) Provisional application No. 60/286,370, filed on Apr. 26, 2001.

(51) Int. Cl.[7] ..... H01H 85/042; H01H 85/02

(52) U.S. Cl. ..... 337/171; 337/172; 337/186

(58) Field of Search ..... 357/168–179, 357/186, 187; 29/623

(56) References Cited

U.S. PATENT DOCUMENTS

| | | | | |
|---|---|---|---|---|
| 2,606,954 A | | 8/1952 | Baker | |
| 2,883,448 A | | 4/1959 | Hermann | |
| 2,961,518 A | | 11/1960 | Hermann | |
| 3,594,676 A | | 7/1971 | Misare | |
| 3,611,240 A | * | 10/1971 | Mikulecky | 337/169 |
| 3,648,211 A | * | 3/1972 | McKeithan | 337/159 |
| 3,868,615 A | * | 2/1975 | Haubein et al. | 337/169 |
| 4,414,527 A | * | 11/1983 | Biller | 337/169 |
| 4,774,488 A | * | 9/1988 | Field | 337/171 |
| 4,833,278 A | | 5/1989 | Lambeth | |
| 4,870,387 A | | 9/1989 | Harmon | |
| 4,945,333 A | * | 7/1990 | Stroud et al. | 337/176 |
| 5,191,311 A | | 3/1993 | Webb et al. | |
| 5,300,912 A | | 4/1994 | Tillery et al. | |
| 5,406,033 A | | 4/1995 | Pazdirek | |
| 5,559,488 A | | 9/1996 | Hassler et al. | |
| 6,031,186 A | | 2/2000 | Sakich et al. | |
| 6,065,207 A | | 5/2000 | Fujii et al. | |

FOREIGN PATENT DOCUMENTS

| | | |
|---|---|---|
| ZA | 20006273 | 7/2001 |

* cited by examiner

*Primary Examiner*—Anatoly Vortman
(74) *Attorney, Agent, or Firm*—Mark S. Bicks; Marcus R. Mickney; Alfred N. Goodman

(57) ABSTRACT

An insulator assembly for a polymeric cutout assembly has a core with first and second ends and an outer surface. First and second end caps are attached at the first and second core ends. The end caps have outer surfaces. A sleeve is disposed on the outer surface of the core. A projection extends laterally outwardly from an outer surface of the sleeve. An insulator is molded around the outer surface of the core, the sleeve and the first and second end caps. A center pin is attached to the projection to secure the cutout assembly to a support.

70 Claims, 7 Drawing Sheets

POLYMERIC CUTOUT ASSEMBLY

CROSS-REFERENCE TO RELATED APPLICATION

This application claims the benefit under 35 U.S.C. §119 (e) of provisional patent application Serial No. 60/286,370, filed Apr. 26, 2001.

FIELD OF THE INVENTION

The present invention relates to polymeric cutout assemblies for power distribution systems. More particularly, the present invention relates to an insulator assembly for a polymeric cutout assembly. Still more particularly, the present invention relates to anti-rotational end caps, sleeve and center pin assemblies, and non-ceramic insulation for insulator assemblies.

BACKGROUND OF THE INVENTION

A cutout assembly or sectionalizer is a protective device having a fuse element located between the high voltage power line and the distribution network grid. In the event of a fault due to a high current surge on the power line, the fuse element is designed to blow (melt) and instantly remove power from the section of the grid being protected by the cutout. This device keeps the entire grid from going down; thus, power is lost only in the section where the fault occurred.

A cutout assembly is formed of two basic parts, a fuse link holder built around an insulator and a fuse assembly connected to the fuse link holder. The fuse assembly pivots downward after a fault current activates and blows the fuse element located within the fuse assembly. When the fuse element activates and the fuse assembly pivots downward, considerable physical force is exerted on the insulator. Hence, the insulator is typically made from porcelain or other ceramic materials for added strength to prevent damage when the fuse element activates. These porcelain insulators, however, are usually heavy and bulky, require specialized assembly fixtures or processes, and are awkward to handle and ship. The porcelain insulators, being ceramic, are also brittle and easily chipped or broken. Furthermore, center pins and end pins are attached to the porcelain with a sulfur cement, which adds weight to the assembly and is prone to cracking over time.

When the fuse element of a fuse assembly activates, a lineman from a utility company needs only to see which cutout assembly has a fuse assembly hanging in the downward position. From this he can determine which part of the network grid is faulted, locate and fix the cause of the fault, remove the fuse assembly with a hot stick, replace the fuse element inside the fuse assembly, and reinstall the fuse assembly to reenergize the cutout assembly and once again protect the distribution network grid.

Examples of existing cutout assemblies are disclosed in U.S. Pat. No. 5,300,912 to Tillery et al.; U.S. Pat. No. 5,559,488 to Hassler et al.; U.S. Pat. No. 4,870,387 to Harmon; U.S. Pat. No. 3,594,676 to Misare; and U.S. Pat. No. 2,961,518 to Hermann.

Center pins and end pins are often attached to porcelain with a sulfur cement, which results in a heavy and bulky insulator assembly. That increases the required inventory for the cutout assembly and increases assembly and handling time. Thus, there is a continuing need to provide improved insulator assemblies for polymeric cutout assemblies for power distribution systems.

SUMMARY OF THE INVENTION

Accordingly, it is an object of the present invention to provide an insulator assembly for a polymeric cutout assembly that has a center tube and end caps that are connected to the rod without the use of a sulfur cement.

Another object of the present invention is to provide an insulator assembly to which the center tube and end caps are crimped to the rod, an insulator is molded around the rod assembly, and a center pin is crimped to the center tube.

The foregoing objects are basically attained by an insulator assembly for a polymeric cutout assembly. The insulator assembly has a core that has first and second ends and an outer surface. First and second end caps are attached at the first and second core ends, respectively. The end caps have outer surfaces. A sleeve is disposed on the outer surface of the core. A projection extends laterally outwardly from an outer surface of the sleeve. An insulator is molded around the outer surface of the core, the sleeve and the first and second end caps. A center pin is attached to the projection. By forming the insulator assembly in this manner, a cutout assembly is assembled that is not brittle and prone to cracking over time, thereby providing a cutout assembly having a longer useful lifetime. Furthermore, the cutout assembly requires fewer parts to assembly, thereby reducing inventory and resulting in a lighter and easier to assemble cutout assembly.

Other objects, advantages and salient features of the invention will become apparent from the following detailed description, which, taken in conjunction with the annexed drawings, discloses preferred embodiments of the invention.

DRAWINGS

Referring now to the drawings that form a part of the original disclosure:

DETAILED DESCRIPTION OF THE INVENTION

Figure 2:
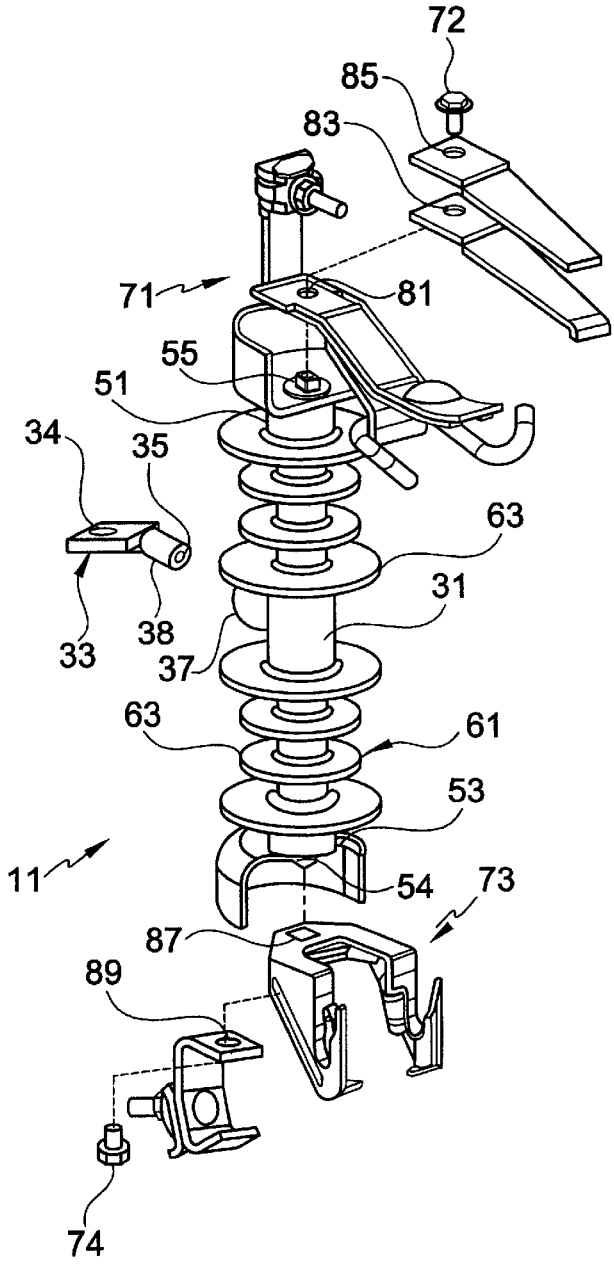
FIG. 2 is an exploded perspective view of the insulator assembly of FIG. 1, showing the center pin surrounding the tube.
Figure 3:
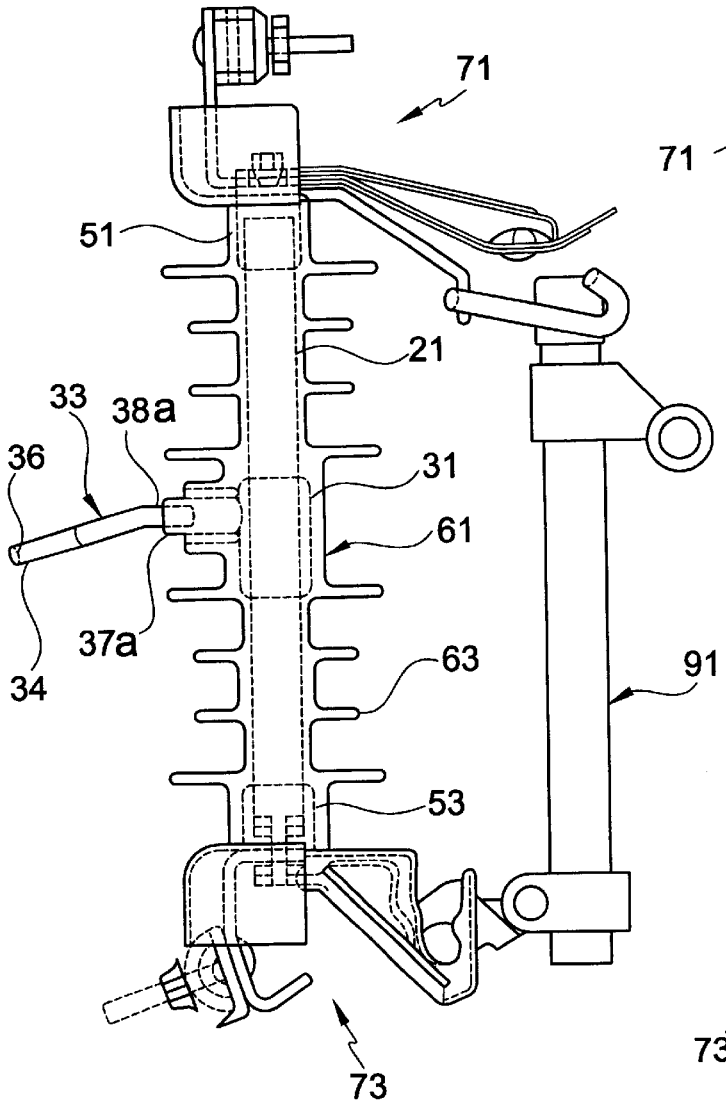
FIG. 3 is a side elevational view of an insulator assembly according to a second embodiment of the present invention, showing a center pin inserted within a center tube.
Figure 4:
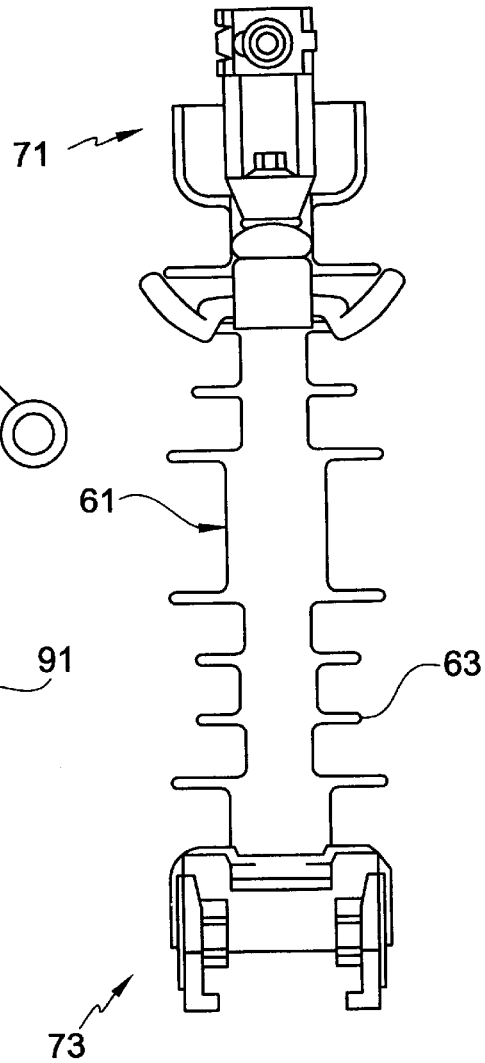
FIG. 4 is a front elevational view of the insulator assembly of FIG. 1.
Figure 5:
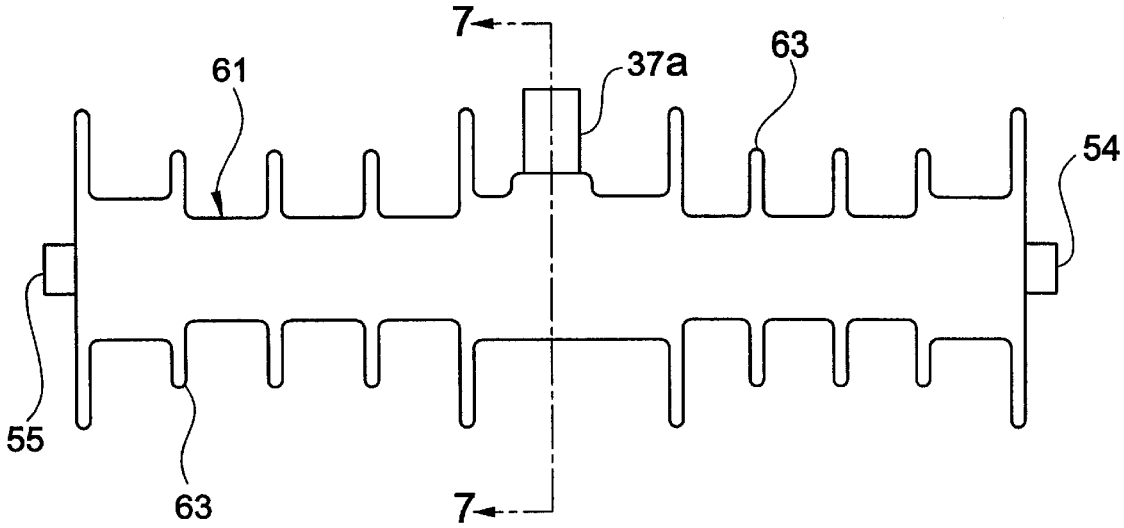
FIG. 5 is a side elevational view of the insulator assembly of FIG. 3, without the top and bottom bracket assemblies and without the center pin.
Figure 6:
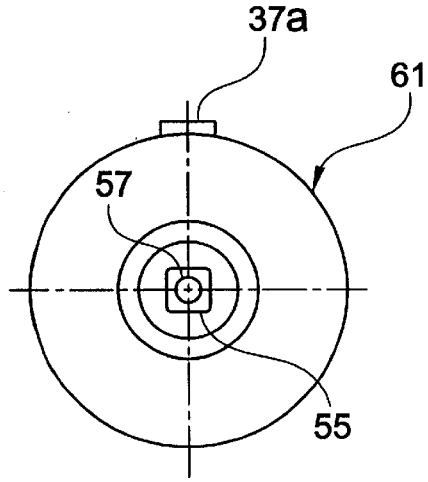
FIG. 6 is a top plan view of the insulator assembly of FIG. 5.
Figure 7:
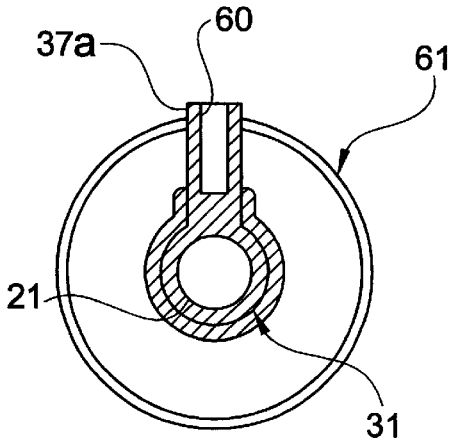
FIG. 7 is an end elevation in section view of the insulator assembly taken along line 7—7 of FIG. 5.

As shown in FIGS. 1–19, the present invention relates to a polymeric cutout assembly having an insulator assembly 11 and a fusetube assembly 91 (FIG. 3). The insulator assembly 11 has a core 21 having first and second ends 23 and 25 and an outer surface 24. First and second end caps 51 and 53 are attached at first and second core ends, respectively. A sleeve 31 is disposed on the outer surface 24 of the core 21. A projection 37 extends laterally outwardly from an outer surface 32 of the sleeve 31. An insulator 61 is molded around the core outer surface 24, sleeve 31 and end caps 51 and 53. A center pin 33 is attached to the projection 37 to secure the cutout assembly to a support.

Figure 8:
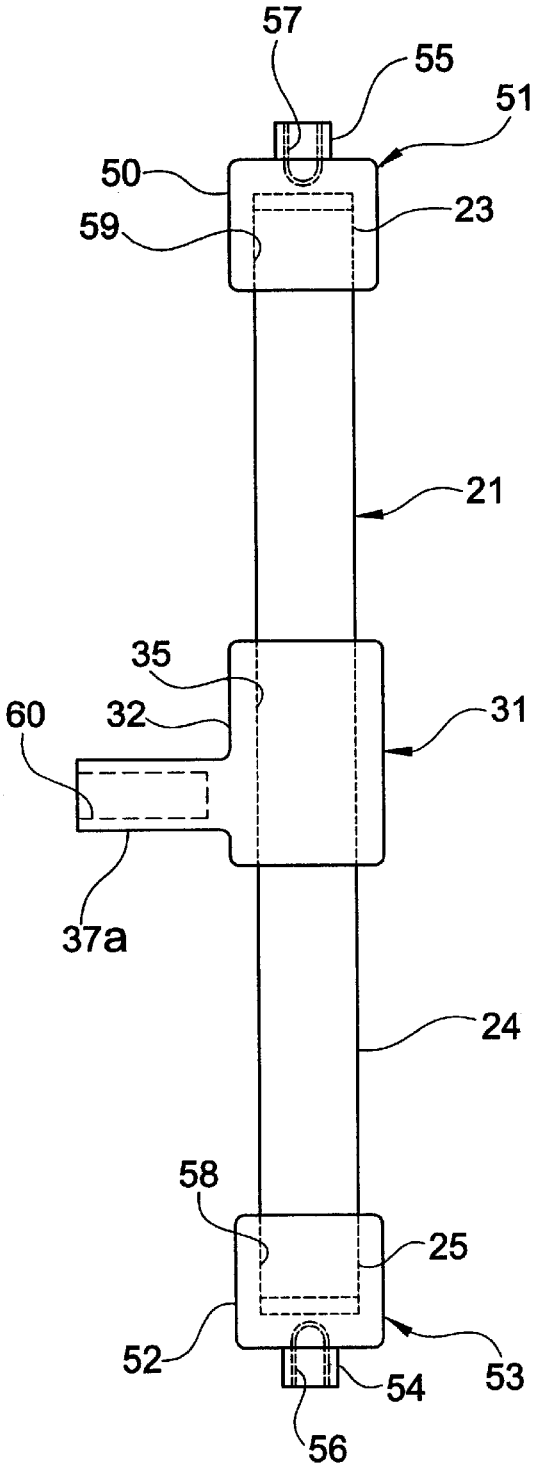
FIG. 8 is a side elevational view of the rod with end caps and a center tube attached.
Figure 9:
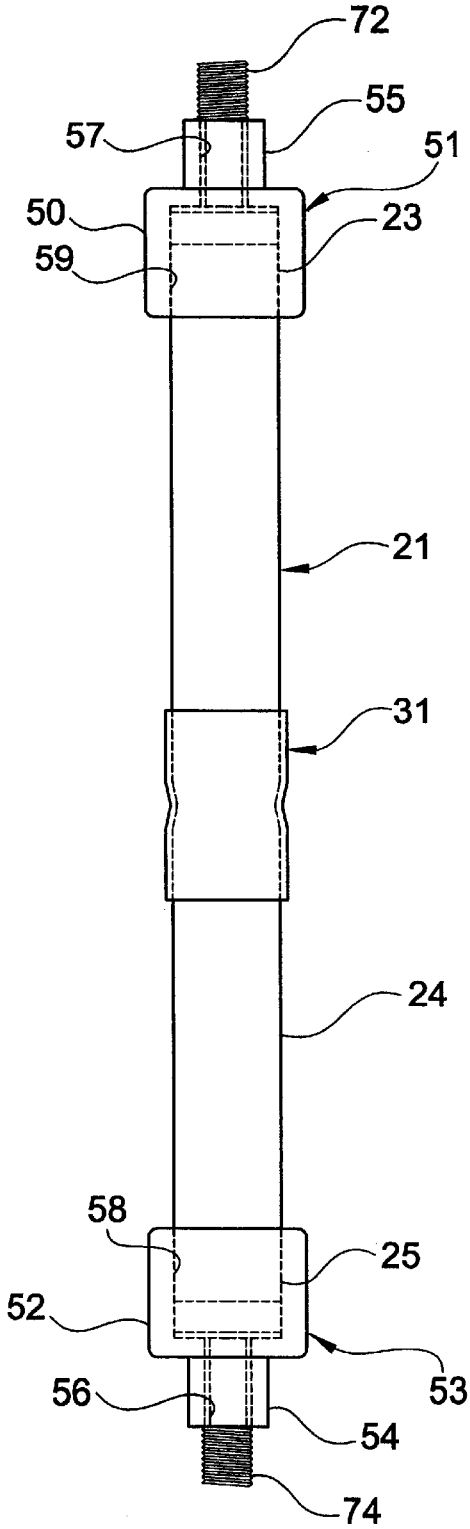
FIG. 9 is a rear view of the rod of FIG. 8, with a fastener threaded into each end cap.
Figure 10:
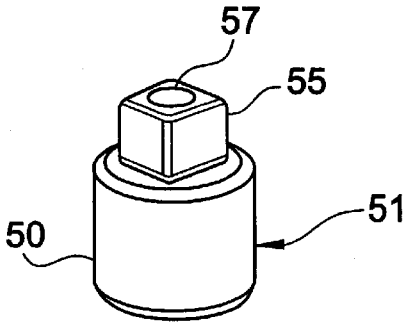
FIG. 10 is a perspective view of an end cap of the insulator assembly of FIG. 1.
Figure 11:
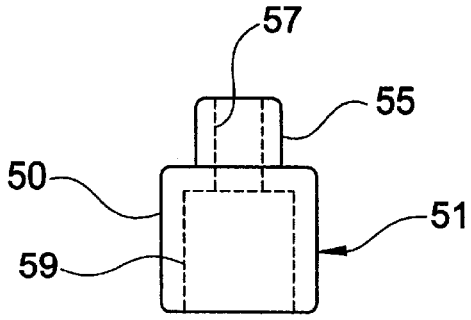
FIG. 11 is a front elevational view of the end cap of FIG. 10.
Figure 12:
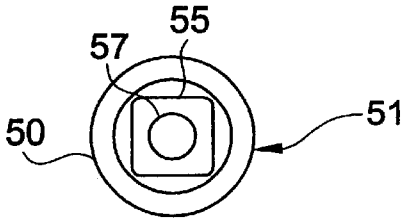
FIG. 12 is a top plan view of the end cap of FIG. 10.

As shown in FIGS. 8 and 9, a core or rod 21 has a first end 23, a second end 25 and an outer surface 24. The core 21 provides the mechanical strength for the polymeric cutout assembly 11. Preferably, the core 21 is made of a non-conductive material, such as an epoxy glass material.

Identical end caps 51 and 53 are provided at the first and second rod ends 23 and 25, as shown in FIGS. 8–12. The end caps 51 and 53 have first portions 50 and second portions 55 that are coaxially aligned. The first portions 50 are preferably cylindrical and have bores 59 for receiving core 21. The second portions 55 are bosses attached to end caps 51 and 53 opposite the bore end. The second portions 55 may be attached to the first portions 50 in any suitable manner, such as by welding the second portions to the first portions. Alternatively, the first and second portions may be a unitary, one-piece construction. Preferably, the second portions 55 have a cubic shape. Internally threaded fastener holes 57 in the second portions 55 and 54 receive fasteners 72 and 74 for securing the fusetube holding bracket assemblies 71 and 73 to the end caps 51 and 53, as shown in FIGS. 1–4. Preferably, the end caps 51 and 53 are made of aluminum.

Figure 1:
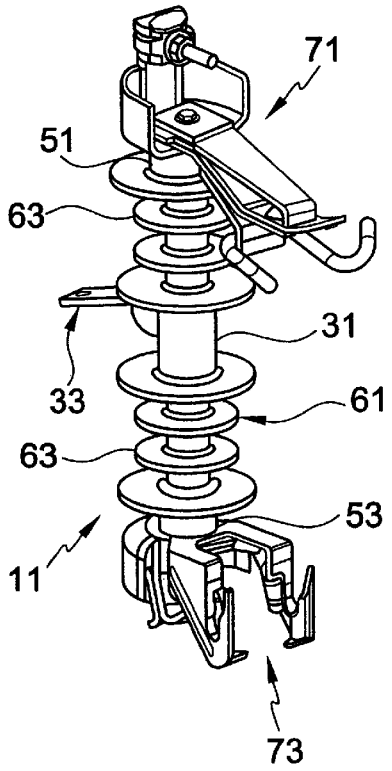
FIG. 1 is a perspective view of an insulator assembly for a polymeric cutout assembly according to a first embodiment of the present invention.

As shown in FIGS. 1 and 2, bracket members of the holding bracket assemblies 71 and 73 have openings 81, 83, 85, 87 and 89 corresponding to the shape of the corresponding end cap second portions 55. Unlike circular shaped end caps, the rectangular or square shaped second portions 55 of end caps 51 and 53 substantially prevent rotation of the bracket assemblies 71 and 73 relative to the end caps, thereby securely fixing the fusetube assembly to the insulator assembly 11. The bracket assemblies 71 and 73 provide mechanical and electrical connections for the fusetube assembly.

Figure 13:
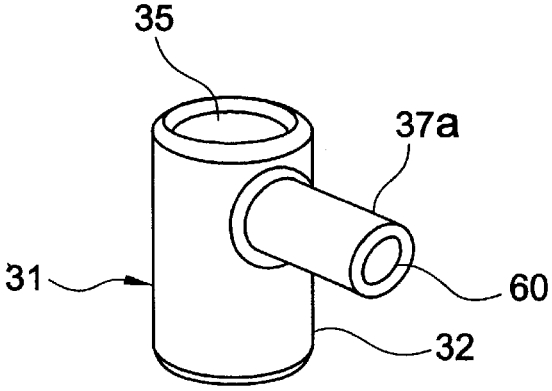
FIG. 13 is a perspective view of a center tube of the insulator assembly of FIG. 3.
Figure 14:
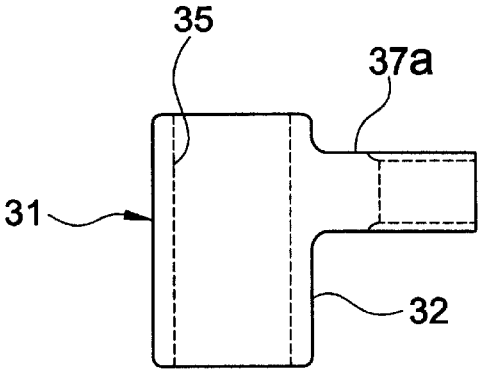
FIG. 14 is a side elevational view of the center tube of FIG. 13.
Figure 15:
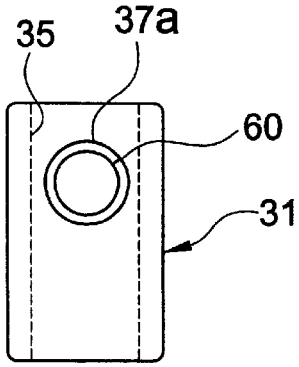
FIG. 15 is a front elevational view of the center tube of FIG. 13.
Figure 16:
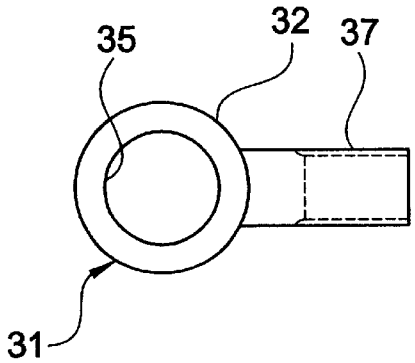
FIG. 16 is a top plan view of the center tube of FIG. 13.

The sleeve or center tube 31 is positioned coaxially on core 21, as shown in FIGS. 8, 9, and 13–16. The sleeve 31 is a substantially T-shaped fitting, as shown in FIGS. 8, 13 and 14. A bore 35 through one longitudinal axis of the sleeve 31 receives the rod 21. A projection 37 extends laterally from an outer surface 32 of the sleeve 31. Preferably, the projection 37 is substantially perpendicular to the longitudinal axis of the bore 35. The projection 37 is preferably solid. In a second embodiment shown in FIG. 13, the projection **37*a* has an opening 60 to make it hollow. Preferably, the sleeve 31** is made of aluminum.

Figure 17:
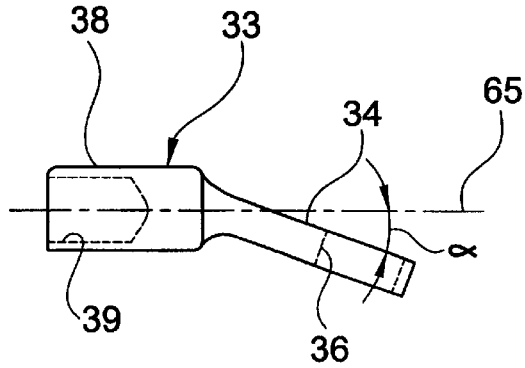
FIG. 17 is a side elevational view of a center pin of the insulator assembly of FIG.
Figure 18:
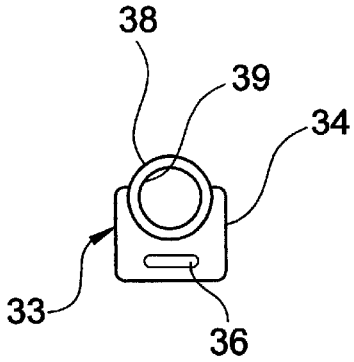
FIG. 18 is a front elevational view of the center pin of FIG. 17.
Figure 19:
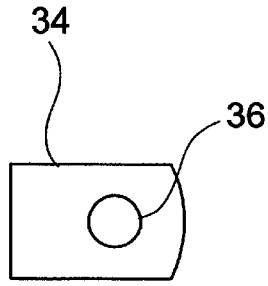
FIG. 19 is a partial top plan view of the center pin of FIG. 17.

As shown in FIGS. 1–3 and 17–19, the center pin 33 has a bore 39 for receiving the projection 37. The center pin 33 has first and second sections 38 and 34. The first section 38 is preferably cylindrical and is attached to the projection 37. In the first embodiment, the first section 38 has an opening 39, as shown in FIG. 17, for receiving the projection 37. In a second embodiment shown in FIG. 3, the first section **38*a* may be solid for inserting into an opening 60 in the projection 37*a*. Extending angularly from the first section 38 of the center pin 33 is the second section 34, which is substantially flat. Preferably, the second section 34 forms an acute angle $\alpha$ with the longitudinal axis 65 of the first section 38, as shown in FIG. 17. Preferably, angle $\alpha$ is approximately 17.5 degrees. An opening 36 in the second portion of the center pin 33 is used to secure the polymeric cutout assembly to a utility pole (not shown) or to a suitable support where the cutout assembly 11 is to be used. Preferably, the center pin 33** is made of galvanized steel.

A polymeric material is molded over and bonded to the core 21 once the end caps 51 and 53 and the sleeve 31 have been attached to the core to form an insulator 61 for the cutout assembly. The insulator 61 preferably has a plurality of weathersheds 63 Preferably, the insulator 61 is a polymeric material, such as an ESP or EPDM (ethylene-propylene-diene monomer) rubber.

Assembly and Disassembly

As shown in FIGS. 8 and 9, sleeve 31 is crimped onto core 21. End caps 51 and 53 are then crimped at first and second ends 23 and 25 of the core, respectively. A polymeric insulator is then molded around and bonded to the core, end caps and sleeve assembly by any conventional method, such as by injection molding, to form an insulator 61.

Once the polymeric molding process has been completed, the center pin 33 is attached to sleeve 31. In the first embodiment, the opening 39 in the first section 38 of center pin 33 receives projection 37 and the center pin is crimped to the sleeve 31. In a second embodiment shown in FIG. 3, the opening 60 in the projection **37*a* receives the first section 38*a* of the center pin 33. The sleeve 31 is then crimped to the center pin 33. An opening 36 in the second section 34 of the center pin 33** receives a fastener to secure the polymeric cutout assembly to a utility pole or other suitable support.

Bracket assemblies 71 and 73 have openings shaped to correspond to the second portions 55 and 54 of the end caps 51 and 53, respectively, as shown in FIG. 2. Fasteners 72 and 74 secure the bracket assemblies 71 and 73 to the end caps 51 and 53, respectively. The rectangular shaped second portions prevent rotation of the bracket assemblies 71 and 73 relative to the insulator assembly 11, thereby preventing rotation of the fusetube assembly. The fusetube assembly is secured between the bracket assemblies 71 and 73 by any conventional method.

Third Embodiment

The features of polymeric cutout assembly 101 that are similar to polymeric cutout assembly 11 are identified with like reference numbers. The same description of those similar features is applicable.

Figure 20:
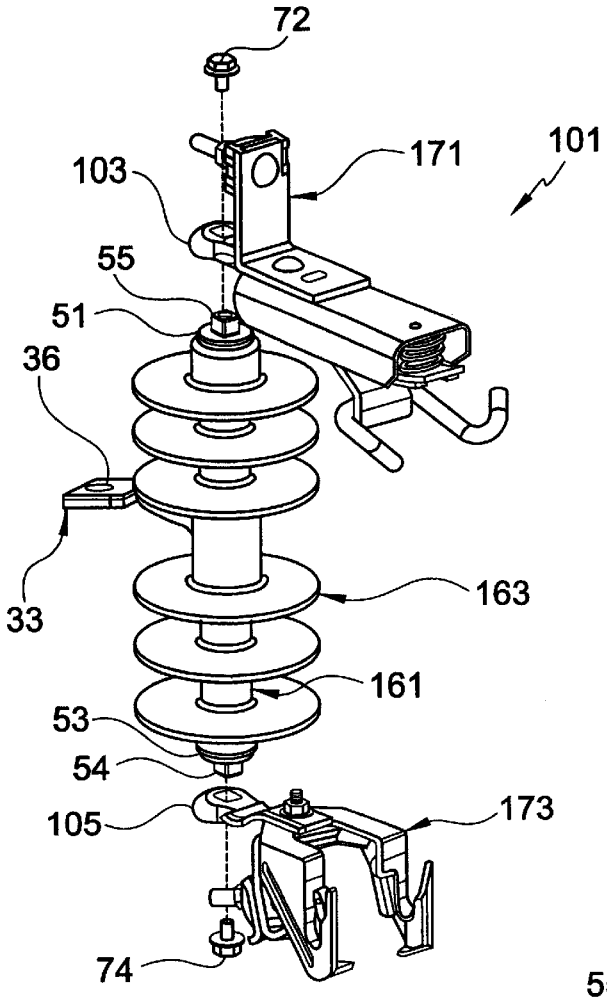
FIG. 20 is an exploded perspective view of an insulator assembly showing the center pin surrounding the tube according to a third embodiment of the present invention.
Figure 21:
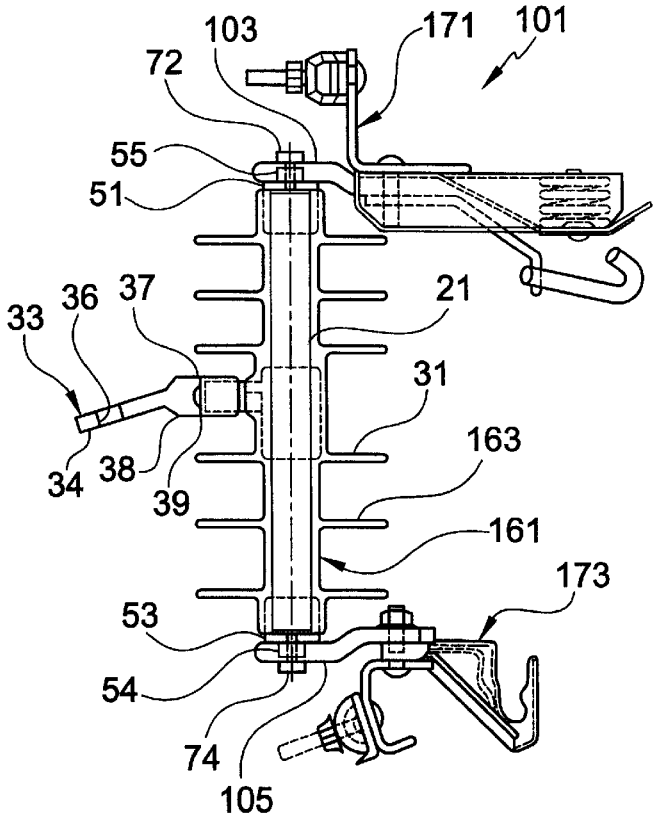
FIG. 21 a side elevational view of the insulator assembly of FIG. 20, showing a center pin surrounding the tube.

As shown in FIGS. 20 and 21, fasteners 72 and 74 secure bracket assemblies 171 and 173 to end caps 51 and 53, respectively. Mounting brackets 103 and 105 are used to hold bracket assemblies 171 and 173 further from polymeric cutout assembly 101 than in the first and second embodiments shown in FIGS. 1 and 3. The bracket assemblies 171 and 173 provide mechanical and electrical connections for the fusetube assembly.

A polymeric material is molded over and bonded to core 21 once end caps 51 and 53 and sleeve 31 have been attached to the core to form an insulator for the cutout assembly 101. Insulator 161 has a plurality of weathersheds 163. Preferably, each weathershed 163 is the same size, thereby increasing the dielectric strength of the polymeric cutout assembly 101. Preferably, the insulator 161 is a polymeric material, such as ESP or EPDM (ethylene-propylene-diene monomer) rubber.

While advantageous embodiments have been chosen to illustrate the invention, it will be understood by those skilled in the art that various changes and modifications may be made therein without departing from the scope of the invention as defined in the appended claims.

What is claimed is:

1. An insulator assembly for a polymeric cutout assembly, comprising:

a core having first and second ends and an outer surface;

first and second end caps attached at said first and second core ends, respectively, said end caps having outer surfaces;

a sleeve disposed on said outer surface of said core, a projection extending laterally outwardly from an outer surface of said sleeve;

an insulator molded around said outer surface of said core, said sleeve and said first and second end caps; and a center pin having crimped attachment to said projection.

2. An insulator assembly according to claim 1, wherein said first and second end caps are crimped to said first and second core ends, respectively.

3. An insulator assembly according to claim 2, wherein each said end cap has a base crimped to said core end, and a rectangular boss extending therefrom.

4. An insulator assembly according to claim 1, wherein said sleeve is crimped on said core.

5. An insulator assembly according to claim 4, wherein said sleeve is crimped on said core at a position substantially equidistant from said first and second rod ends.

6. An insulator assembly according to claim 1, wherein said projection extends substantially perpendicularly from said sleeve.

7. An insulator assembly according to claim 1, wherein said center pin is crimped to said sleeve projection.

8. An insulator assembly according to claim 1, wherein said sleeve projection is crimped to said center pin.

9. An insulator assembly according to claim 1, wherein said insulator includes a plurality of weather sheds on an outer surface thereof.

10. An insulator assembly according to claim 1, wherein said insulator is made of a polymer compound.

11. An insulator assembly according to claim 10, wherein said polymer compound is an ESP or EPDM rubber.

12. A polymeric cutout assembly, comprising:

an insulator assembly including a core having first and second ends and an outer surface;

first and second end caps attached at said first and second core ends, respectively, said end caps having outer surfaces;

a sleeve disposed on said outer surface of said core, a projection extending laterally outwardly from an outer surface of said sleeve;

an insulator molded around said outer surface of said core, said sleeve and said first and second end caps; and a center pin having crimped attachment to said projection; and a fusetube assembly attached to said first and second end caps.

13. An insulator assembly according to claim 12, wherein said first and second end caps are crimped to the first and second core ends, respectively.

14. An insulator assembly according to claim 13, wherein each said end cap has a base crimped to said core end, and a rectangular boss extending therefrom, said fusetube assembly being attached to said first and second end cap bosses.

15. An insulator assembly according to claim 12, wherein said sleeve is crimped on said core.

16. An insulator assembly according to claim 12, wherein said sleeve is crimped on said core at a position substantially equidistant from said first and second rod ends.

17. An insulator assembly according to claim 12, wherein said projection extends substantially perpendicularly from said sleeve.

18. An insulator assembly according to claim 12, wherein said center pin is crimped to said projection.

19. An insulator assembly according to claim 12, wherein said sleeve projection is crimped to said center pin.

20. An insulator assembly according to claim 12, wherein said insulator includes a plurality of weather sheds on an outer surface thereof.

21. An insulator assembly according to claim 12, wherein said insulator is made of a polymer compound.

22. An insulator assembly according to claim 21, wherein said polymer compound is an ESP or EPDM rubber.

23. An insulator assembly for a polymeric cutout assembly, comprising:

a core having first and second ends and an outer surface;

first and second end caps attached at said first and second core ends, respectively, said end caps having outer surfaces;

a sleeve disposed on said outer surface of said core, a projection extending laterally outwardly from an outer surface of said sleeve;

an insulator molded around said outer surface of said core, said sleeve and said first and second end caps; and a center pin attached to said projection, said center pin having a first section and a second section, said first section being cylindrical and having a first opening receiving said projection, said second section being integral with said first section and being substantially flat with a second opening for connecting to a support.

24. An insulator assembly according to claim 23, wherein said first and second end caps are crimped to said first and second core ends, respectively.

25. An insulator assembly according to claim 24, wherein each said end cap has a base crimped to said core end, and a rectangular boss extending therefrom.

26. An insulator assembly according to claim 23, wherein said sleeve is crimped on said core.

27. An insulator assembly according to claim 26, wherein said sleeve is crimped on said core at a position substantially equidistant from said first and second rod ends.

28. An insulator assembly according to claim 23, wherein said projection extends substantially perpendicularly from said sleeve.

29. An insulator assembly according to claim 23, wherein said center pin is crimped to said sleeve projection.

30. An insulator assembly according to claim 23, wherein an acute angle is formed between said first and second sections of said center pin.

31. An insulator assembly according to claim 23, wherein said center pin has an angle of approximately 17.5 degrees between said first and said second sections.

32. An insulator assembly according to claim 23, wherein said insulator includes a plurality of weather sheds on an outer surface thereof.

33. An insulator assembly according to claim 23, wherein said insulator is made of a polymer compound.

34. An insulator assembly according to claim 33, wherein said polymer compound is an ESP or EPDM rubber.

35. An insulator assembly for a polymeric cutout assembly, comprising:

a core having first and second ends and an outer surface;

first and second end caps attached at said first and second core ends, respectively, said end caps having outer surfaces;

a sleeve disposed on said outer surface of said core, a projection having a first opening extending laterally outwardly from an outer surface of said sleeve;

an insulator molded around said outer surface of said core, said sleeve and said first and second end caps; and a center pin attached to said projection, said center pin having a first section and a second section, said first section being cylindrical and substantially disposed within said projection first opening, said second section being integral with said first section and being substantially flat with a second opening for connecting to a support.

36. An insulator assembly according to claim 35, wherein said first and second end caps are crimped to said first and second core ends, respectively.

37. An insulator assembly according to claim 36, wherein each said end cap has a base crimped to said core end, and a rectangular boss extending therefrom.

38. An insulator assembly according to claim 35, wherein said sleeve is crimped on said core.

39. An insulator assembly according to claim 38, wherein said sleeve is crimped on said core at a position substantially equidistant from said first and second rod ends.

40. An insulator assembly according to claim 35, wherein said projection extends substantially perpendicularly from said sleeve.

41. An insulator assembly according to claim 35, wherein said center pin is crimped to said sleeve projection.

42. An insulator assembly according to claim 35, wherein an acute angle is formed between said first and second sections of said center pin.

43. An insulator assembly according to claim 35, wherein said center pin has an angle of approximately 17.5 degrees between said first and said second sections.

44. An insulator assembly according to claim 35, wherein said insulator includes a plurality of weather sheds on an outer surface thereof.

45. An insulator assembly according to claim 35, wherein said insulator is made of a polymer compound.

46. An insulator assembly according to claim 45, wherein said polymer compound is an ESP or EPDM rubber.

47. A polymeric cutout assembly, comprising:

an insulator assembly including a core having first and second ends and an outer surface;

first and second end caps attached at said first and second core ends, respectively, said end caps having outer surfaces;

a sleeve disposed on said outer surface of said core, a projection extending laterally outwardly from an outer surface of said sleeve;

an insulator molded around said outer surface of said core, said sleeve and said first and second end caps; and a center pin attached to said projection, said center pin having a first section and a second section, said first section being cylindrical and having a first opening receiving said projection, said second section being integral with said first section and being substantially flat with a second opening for connecting to a support; and a fusetube assembly attached to said first and second end caps.

48. A polymeric cutout assembly according to claim 47, wherein said first and second end caps are crimped to the first and second core ends, respectively.

49. A polymeric cutout assembly according to claim 48, wherein each said end cap has a base crimped to said core end, and a rectangular boss extending therefrom, said fusetube assembly being attached to said first and second end cap bosses.

50. A polymeric cutout assembly according to claim 47, wherein said sleeve is crimped on said core.

51. A polymeric cutout assembly according to claim 47, wherein said sleeve is crimped on said core at a position substantially equidistant from said first and second rod ends.

52. A polymeric cutout assembly according to claim 47, wherein said projection extends substantially perpendicularly from said sleeve.

53. A polymeric cutout assembly according to claim 47, wherein said center pin is crimped to said projection.

54. A polymeric cutout assembly according to claim 47, wherein an acute angle is formed between said first and second sections of said center pin.

55. A polymeric cutout assembly according to claim 47, wherein said center pin has an angle of approximately 17.5 degrees between said first and said second sections.

56. A polymeric cutout assembly according to claim 47, wherein said insulator includes a plurality of weather sheds on an outer surface thereof.

57. A polymeric cutout assembly according to claim 47, wherein said insulator is made of a polymer compound.

58. A polymeric cutout assembly according to claim 57, wherein said polymer compound is an ESP or EPDM rubber.

59. A polymeric cutout assembly, comprising:

an insulator assembly including a core having first and second ends and an outer surface;

first and second end caps attached at said first and second core ends, respectively, said end caps having outer surfaces;

a sleeve disposed on said outer surface of said core, a projection having a first opening extending laterally outwardly from an outer surface of said sleeve;

an insulator molded around said outer surface of said core, said sleeve and said first and second end caps; and a center pin attached to said projection, said center pin having a first section and a second section, said first section being cylindrical and being substantially disposed within said projection first opening, said second section being integral with said first section and being substantially flat with a second opening for connecting to a support; and a fusetube assembly attached to said first and second end caps.

60. A polymeric cutout assembly according to claim 59, wherein said first and second end caps are crimped to the first and second core ends, respectively.

61. A polymeric cutout assembly according to claim 60, wherein each said end cap has a base crimped to said core end, and a rectangular boss extending therefrom, said fusetube assembly being attached to said first and second end cap bosses.

62. A polymeric cutout assembly according to claim 61, wherein said sleeve is crimped on said core.

63. A polymeric cutout assembly according to claim 59, wherein said sleeve is crimped on said core at a position substantially equidistant from said first and second rod ends.

64. A polymeric cutout assembly according to claim 59, wherein said projection extends substantially perpendicularly from said sleeve.

65. A polymeric cutout assembly according to claim 59, wherein said center pin is crimped to said projection.

66. A polymeric cutout assembly according to claim 59, wherein an acute angle is formed between said first and second sections of said center pin.

67. A polymeric cutout assembly according to claim 62, wherein said center pin has an angle of approximately 17.5 degrees between said first and said second sections.

68. A polymeric cutout assembly according to claim 59, wherein said insulator includes a plurality of weather sheds on an outer surface thereof.

69. A polymeric cutout assembly according to claim 59, wherein said insulator is made of a polymer compound.

70. A polymeric cutout assembly according to claim 69, wherein said polymer compound is an ESP or EPDM rubber.

* * * * *